US005394677A

United States Patent [19]

Van Scoyk

[11] Patent Number: 5,394,677

[45] Date of Patent: Mar. 7, 1995

[54] SPURS FOR RIDING SHOES

[75] Inventor: Pershing R. Van Scoyk, 7193 W. 32nd Ave., Wheatridge, Colo. 80033

[73] Assignee: Pershing R. Van Scoyk, Wheatridge, Colo.

[21] Appl. No.: 181,610

[22] Filed: Jan. 13, 1994

[51] Int. Cl.[6] ..... A43C 17/02

[52] U.S. Cl. ..... 54/83.1

[58] Field of Search ..... 54/83.1, 83.2; 36/64, 36/74

[56] References Cited

U.S. PATENT DOCUMENTS

| | | | |
|---|---|---|---|
| 4,443,996 | 4/1984 | Welton et al. | 54/83.1 |
| 4,513,561 | 4/1985 | Welton et al. | 54/83.1 |
| 5,046,650 | 9/1991 | Rothenberg et al. | 223/113 |

FOREIGN PATENT DOCUMENTS

| | | | |
|---|---|---|---|
| 477780 | 10/1951 | Canada | 54/83.1 |
| 54175 | 3/1912 | Germany | 54/83.1 |

*Primary Examiner*—Robert P. Swiatek

*Attorney, Agent, or Firm*—Dorr, Carson, Sloan & Peterson

[57] ABSTRACT

A spur for mounting on a heeled athletic/hiking shoe suitable for riding having a heel and a protrusion adjacent to the heel. The spur includes at least two opposing sides connected at one end by a rear body. A front loop stretches between and extends downwardly from another end of the sides. The spur is formed of flexible material, so that the front loop stretches over the heel to engage the front of the heel with the rear body positioned at the rear of the canvas riding shoe. A structure is added to the rear body and sides for selectively engaging the protrusion, so that the spur is firmly held in place on the riding shoe.

14 Claims, 5 Drawing Sheets

Fig. 3
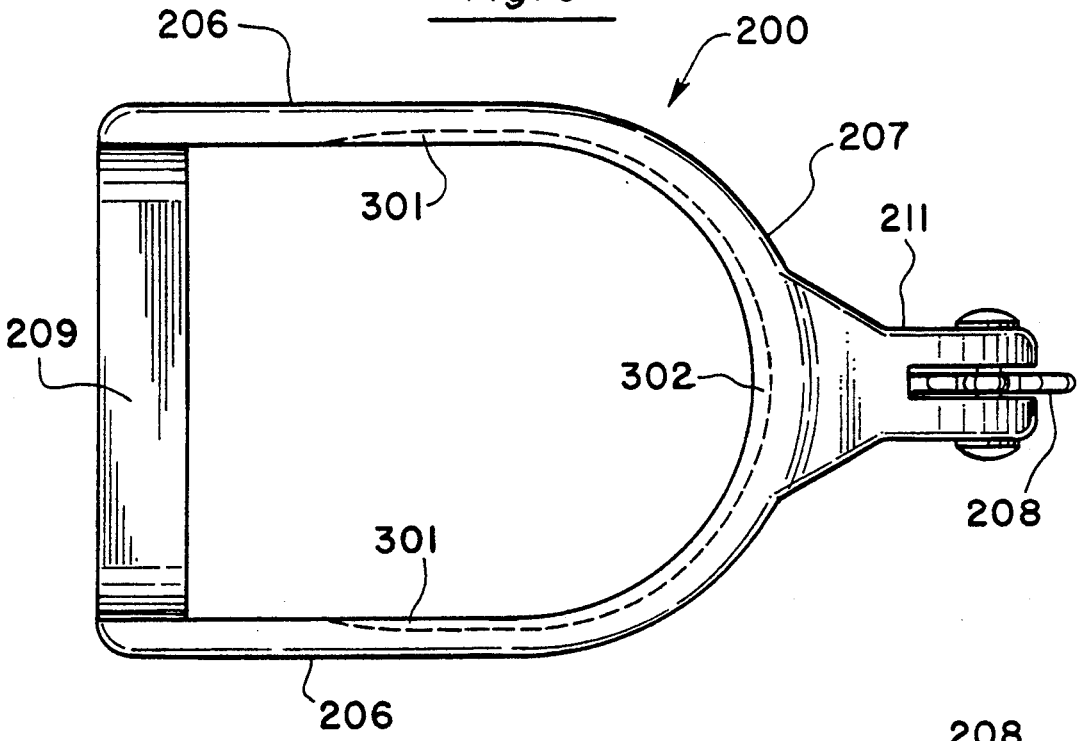
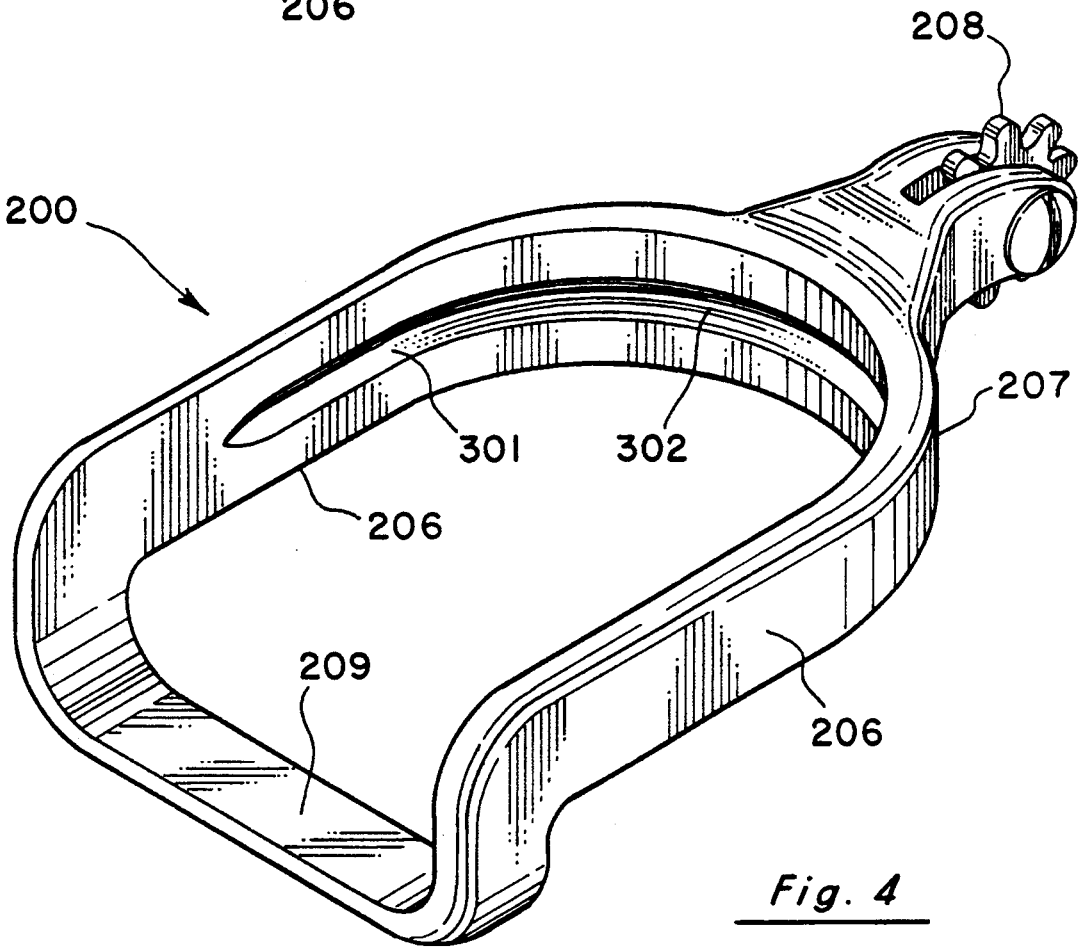
Fig. 4

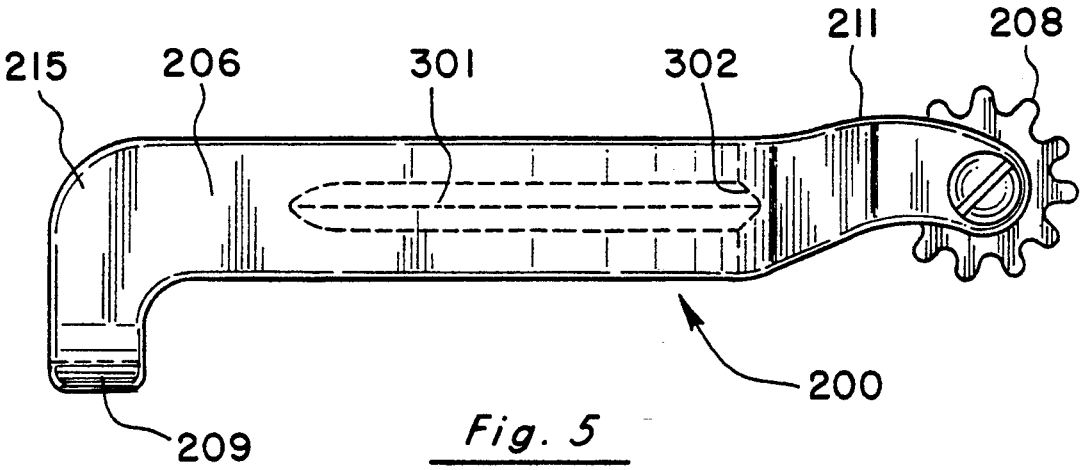
Fig. 5
Fig. 6
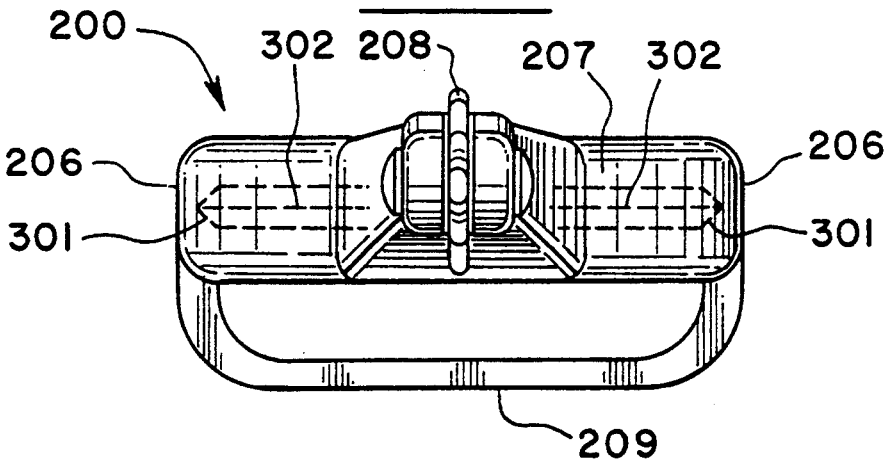
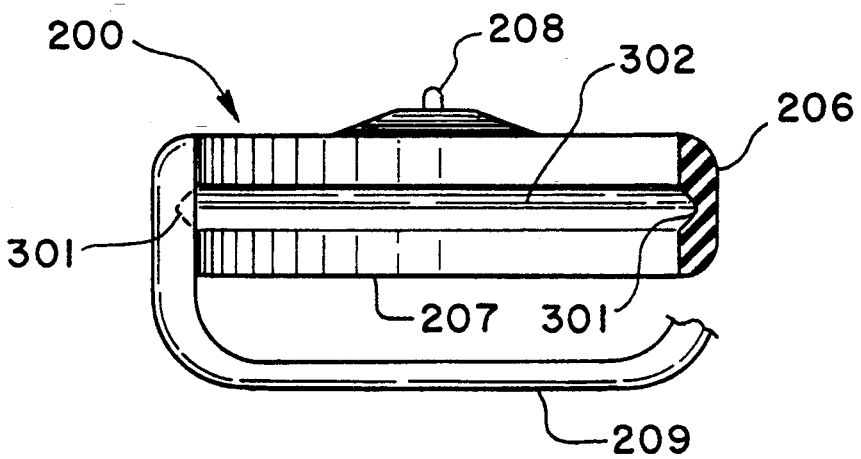
Fig. 7

Fig. 8
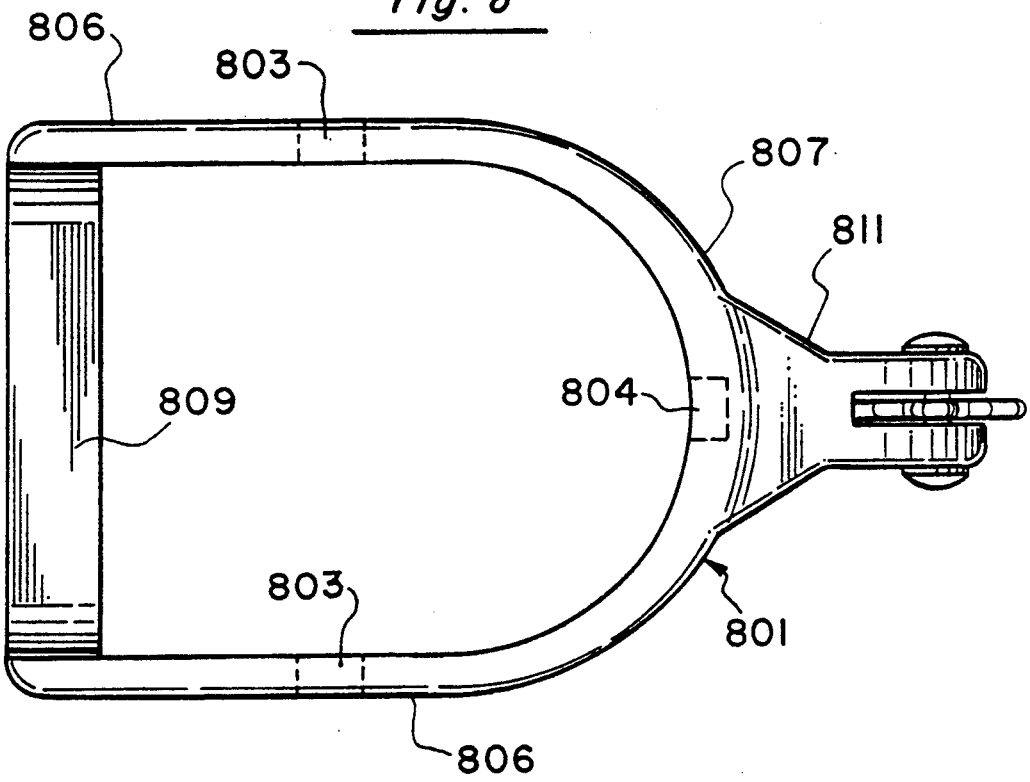
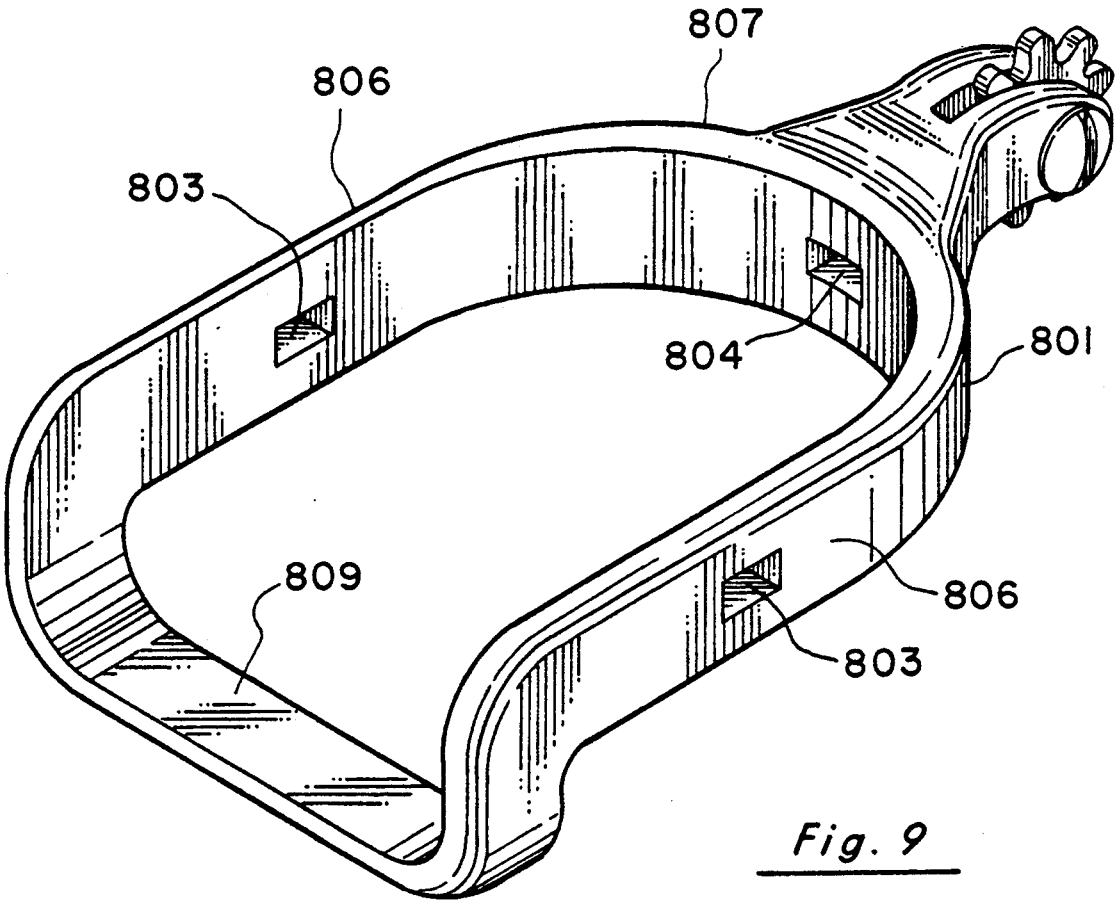
Fig. 9

SPURS FOR RIDING SHOES

BACKGROUND OF THE INVENTION

1. Field of the Invention

The present invention relates generally to the field of spurs for horseback riders. More specifically, the present invention discloses a spur that can be removable and securely mounted on a riding shoe without the use of straps or other methods of attaching the spur to the shoe.

2. Statement of the Problem

Historically, a spur is used to attach to the footwear of a rider to prod a horse. Prior spurs include an attachment for affixing the spur to the footwear of the rider, a shank, and a rowel. The attachment traditionally includes a stiff U-shaped portion that fits around the heel of the footwear and is held on by straps across the top and bottom of the instep. Alternatively, the attachment is made of a flexible material that is stretched around the heel of the footwear. The shank extends from the rear of the spur and acts as the prod and may or may not have a rowel. The rowel is a toothed rotatable wheel inserted into the distal end of the shank.

The rider's footwear, which is called a riding boot or shoe or cowboy boot, has a heel and a counterheel. The heel is the built-up portion of the footwear under the wearer's heel. The counterheel is that part of the footwear above the heel of the footwear that wraps around the wearer's own heel. Conventional riding boots or shoes are made of leather and have a crevice between the heel and the counterheel.

A problem with any spur that requires a strap is that the spur is not readily removable from the boot or shoe without having to undo the strap. Welton et al., U.S. Pat. Nos. 4,513,561 and 4,443,996, disclose a spur holder and spur that are flexible and can be removable mounted on a conventional leather boot without the need for an additional strap to hold the spur in place on the boot. This is done by the use of a ridge as an integral part of the spur holder or spur. This ridge fits into a crevice between the heel and the counterheel of the conventional riding boot, holding the spur in position on the boot. Rothenberg et al., U.S. Pat. No. 5,046,650, disclose a similar device for removing a conventional leather boot that also contains an interior rib that fits into the crevice on a conventional leather boot.

An increasing number of experienced riders, however, are now using heeled athletic/hiking shoes suitable for riding instead of conventional leather riding boots. Riding shoes are more comfortable, more versatile, less expensive, and easier to care for than conventional leather boots. These advantages mean that the market for riding shoes is expanding rapidly. However, riding shoes do not have a convenient built-in crevice similar to that of conventional leather boots described above, and the Welton spur holder and spur is more difficult to use with them. Also, because the overall shape of the riding shoe is different from that of riding boots, conventional spurs often do not fit the canvas riding shoe. A need therefore exists for a spur that is flexible, that can easily be mounted and removed from a riding shoe, and that does not move in relation to the riding shoe when in use.

3. Solution to the problem

The present invention provides a spur that is easily placed on or removed from a heeled athletic/hiking shoe suitable for riding, without the necessity of fastening or unfastening any straps. The spur is easily and economically molded in one piece using a flexible material, or may be formed from rigid materials such as metal. The spur of the present invention self-aligns to a correct position on the riding shoe whether made of flexible or rigid material. The spur of the present invention can be made to firmly attach to a canvas riding shoe with or without straps. The construction of the spur holds the shank of the spur in a firm position on the heel and counterheel, also known as heel counter, of a riding shoe.

SUMMARY OF THE INVENTION

A flexible spur of this invention includes a curved rear body and a front loop that are connected by sides, to form a cavity that permits the spur to be stretched over the heel of a heeled athletic/hiking shoe suitable for riding. The interior of the rear body and a major portion of the sides contains a groove. The groove is adapted to fit over a ridge on the counterheel of a riding shoe, to restrain upward or downward movement of the spur. The groove allows the spur to be used with any riding shoe that has a corresponding ridge. The spur is formed of a material having a high resistance to fatigue stress. The spur of the present invention can be made of flexible or solid material. A rearwardly extending shank is provided for use as a prod or for mounting a rowel.

BRIEF DESCRIPTION OF THE DRAWING

The present invention can be more readily understood in conjunction with the accompanying drawings, in which:

FIG. 3 is a top plan view of the first embodiment spur in accordance with the present invention;

FIG. 4 is a front perspective view of a spur in accordance with the present invention;

FIG. 5 is a side plan view of the first embodiment spur shown in FIG. 4;

FIG. 6 is a rear elevation view of a spur in accordance with the present invention;

FIG. 7 is a front elevation view of a spur in accordance with the present invention;

FIG. 8 is a top plan view of a second embodiment spur in accordance with the present invention; and FIG. 9 is a front perspective view of the spur shown in FIG. 8.

DETAILED DESCRIPTION OF THE DRAWING

1. Overview

Figure 1A:
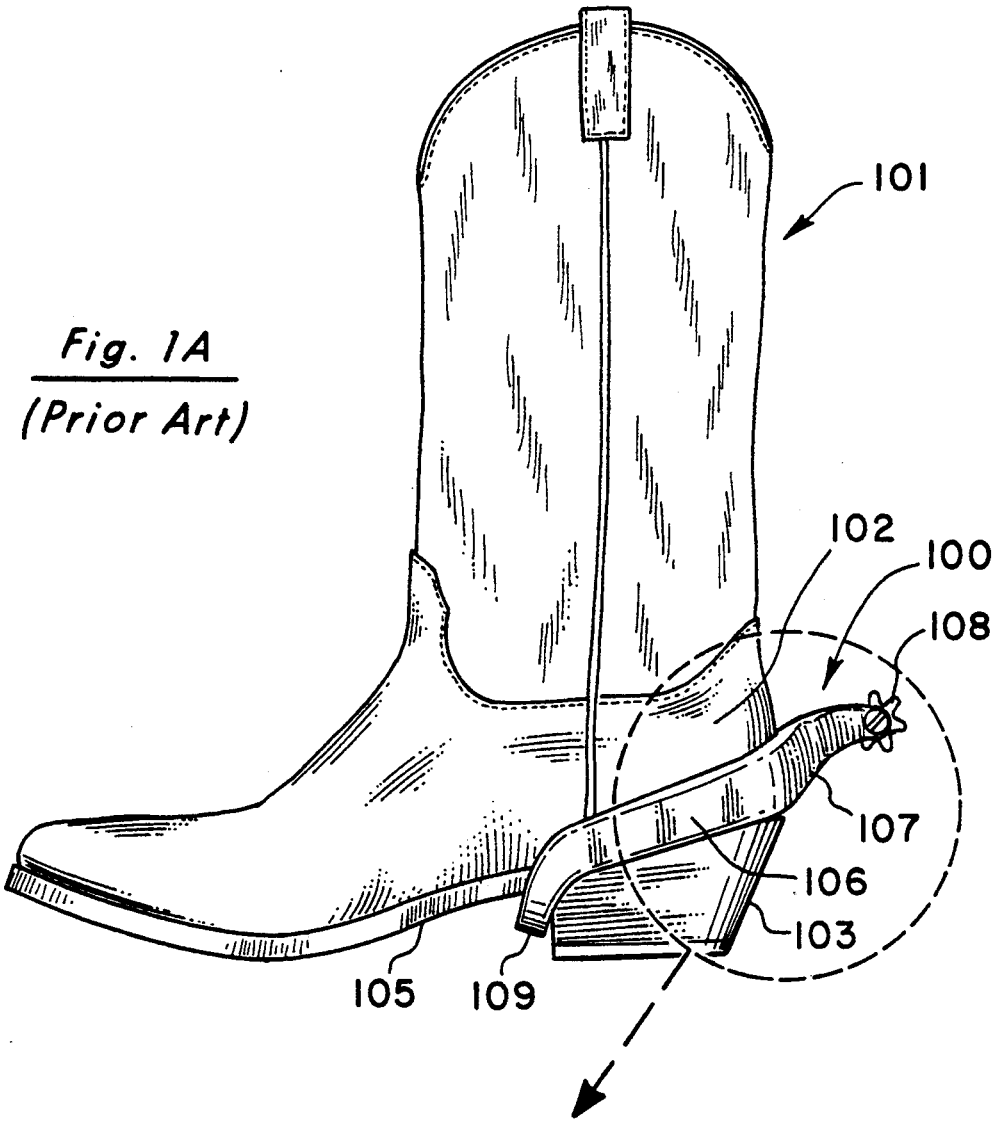
Fig. 1A (Prior Art)
FIG. 1A is a side view of a conventional leather boot showing how the ridge of a prior art spur fits into the crease between the heel and the counterheel.
Figure 1B:
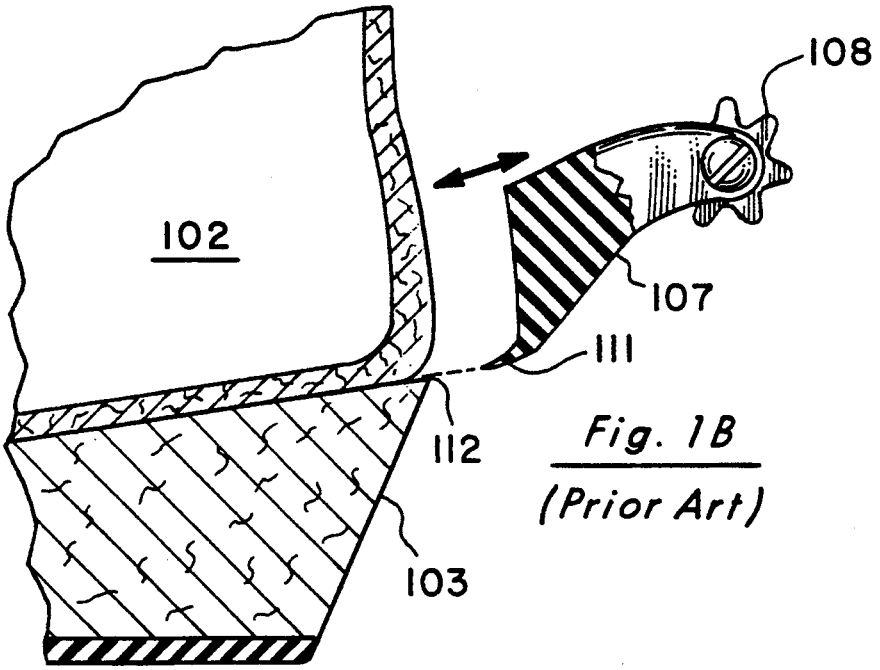
Fig. 1B (Prior Art)
FIG. 1B is an enlarged cross-sectional view of a portion of the prior art spur shown in FIG. 1A.

FIG. 1A and FIG. 1B illustrate a prior art flexible spur 100 used with a conventional leather riding boot 101. Prior art spur 100 is similar to that described U.S. Pat. No. 4,513,561. Boot 101 includes a counterheel 102 which is traditionally made of natural or synthetic leather or a similar stiff material such as plastic. Heel 103 is attached to counterheel 102 and is made from a rigid material.

Prior art spur 100 is made of a flexible material such as neoprene and has sides 106 (one of which is visible in FIG. 1A) and a rear portion 107 which connects sides 106. Rear portion 107 fits around a back outer surface of counterheel 102. Sides 106 extend away from rear portion 107 along a junction that is formed between heel 103 and counterheel 102. A front portion 109, also called a front loop 109, stretches over a front surface of heel 103 to frictionally engage the front surface of heel 103. Front loop 109 also frictionally engages a portion of sole 105 to affix spur 100 to boot 101.

As shown in the enlarged view of FIG. 1B, a groove 112 is naturally formed at the junction of counterheel 102 and heel 103. The rear portion 107 of prior art spur 100 is pulled away from counterheel 102 for ease of understanding as suggested by the arrows in FIG. 1B. In prior art spur 100, a ridge 111 is formed near the bottom of rear portion 107. Ridge 111 is designed to fit into natural groove 112 to snugly hold spur 100 onto boot 101. The attachment between ridge 111 and groove 112 prevents spur 100 from moving up or down with respect to counterheel 102 and heel 103.

Figure 2A:
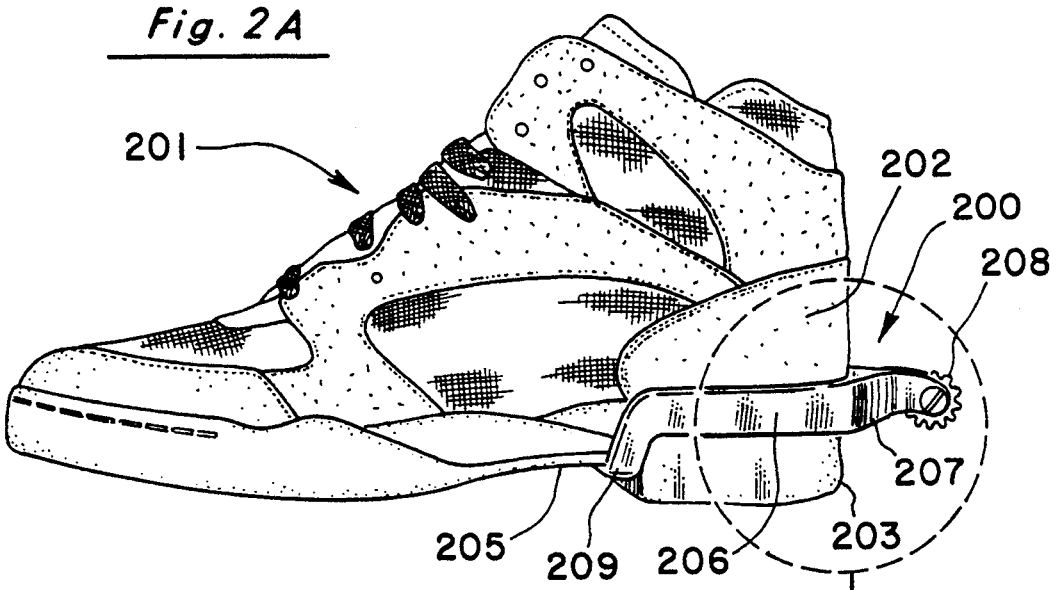
FIG. 2A shows a side elevation view of a first embodiment spur in accordance with the present invention attached to a riding shoe.

FIG. 2A illustrates improved spur 200 in accordance with the present invention affixed to a riding shoe 201. Riding shoe 201 resembles a heeled athletic/hiking shoe suitable for riding. Riding shoe 201 includes a counterheel 202 and a heel 203. Unlike conventional heel 203, however, a riding shoe heel 203 can be made of a resilient material. Also, counterheel 202 may be made of a softer, more flexible material than the leather or plastic used in conventional counterheel 102.

Spur 200 includes two sides 206 (one of which is visible in FIG. 2A) which are connected to each other by rear portion 207. Sides 206 extend forwardly away from rear portion 207 along the junction between counterheel 202 and heel 203. Spur 200 in accordance with the present invention also includes a front loop 209 which connects the forward ends of sides 206 and is offset downwardly with respect to sides 206. Front loop 209 frictionally engages a front surface of heel 203 and a portion of sole 205.

Figure 2B:
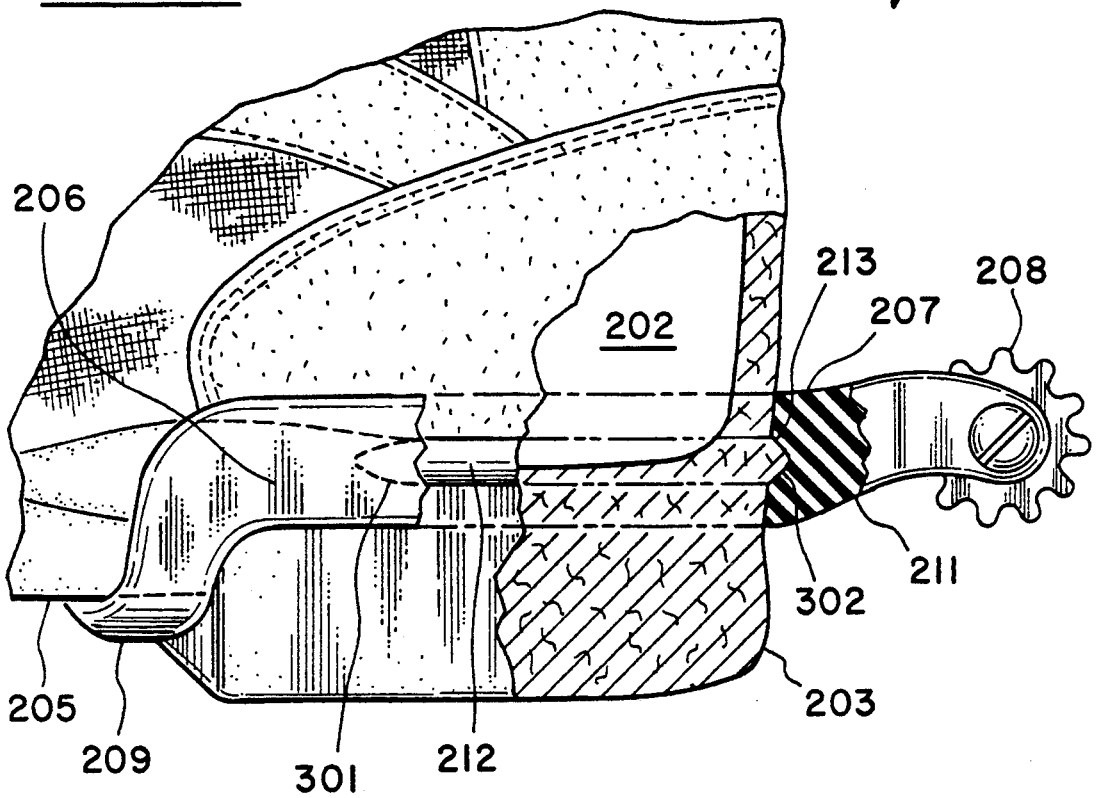
FIG. 2B is an enlarged cutaway view of a portion of the spur shown in FIG. 2A.

As shown in FIG. 2B, flexible spur 200 has a rear portion 207 which attaches to shank 211. Shank 211 includes an upright, longitudinal slot in its distal portion to support rowel 208. Rowel 208 is conveniently mounted in the longitudinal slot with a pin as shown in FIG. 2B. Preferably, shank 211 and rear portion 207 are formed as an integral, one-piece structure.

Counterheel 202 and heel 203 of riding boot 201 are not joined so as to form a natural groove 112 (shown on prior art boot 101 in FIG. 1B). This is a result of the materials used to form a comfortable, practical riding shoe 201, as well as the manufacturing techniques that more closely resemble construction of an athletic/hiking shoe. As a result, there is no integral groove 112 in which to affix spur 200. However, riding shoe 201 can be manufactured to include an integral ridge 212 along the sides of the shoe 201. Also, the integral ridge may extend around a rear portion of the shoe to form a rear ridge 213 (shown in FIG. 2B).

In the first embodiment, ridges 212 and 213 form a continuous semi-circle or U-shaped protrusion around a rear outer surface of heel 203. Ridges 212 and 213 may be formed integrally with heel 203 as a molded protrusion. Alternatively, ridges 212 and 213 may be formed as a part of counterheel 202 either by forming a molded protrusion (if counterheel 202 is made of plastic) or by a sewn ridge or bump in counterheel 202. Also, ridges 212 and 213 could be formed simply by bonding a cord or other protrusion to the outer surface of heel 203 or counterheel 202. Ridges 212 and 213 are preferably located near the junction between counterheel 202 and heel 203 but, unlike the prior art riding boot 101, may be positioned somewhat above or below the exact junction of counterheel 202 with heel 203.

An important feature of the present invention, which is described in greater detail below, is a groove including side portion 301 and rear portion 302 formed in spur 200. Grooves 301 and 302 are preferably sized and positioned to selectively engage ridges 212 and 213, respectively. Likewise, side walls 206 and rear portion 207 are preferably sized and shaped to mate with the overall shape of counterheel 202 and counterheel 203 of riding shoe 201. These improvements to a flexible spur design allow flexible spur 200 to be reliably and removably affixed to a riding shoe 201 so as to firmly hold spur 200 to heel 203 even though the integral groove 112 (shown in FIG. 1B) no longer exists and prevent vertical motion of the spur even during use.

Although spur 200 in accordance with the present invention, including sides 206, rear portion 207, front loop 209, and shank 211, is molded as a single part in the preferred embodiment, it should be understood that other manufacturing techniques may be used. For example, each part can be molded separately and subsequently joined to form an assembled spur 200. Also, spur 200 is illustrated as having shank 211 and rowel 208 permanently attached, but it should be understood that these portions may be made removable or replaced with a blunt prod without departing from the teachings of the present invention. Further, spur 200 may be useful for other types footwear so long as a protrusion such as ridges 212 and 213 is provided in a convenient position.

2. Example 1

FIG. 3 through FIG. 7 illustrate details of a first embodiment spur 200 in accordance with the present invention. FIG. 3 shows a top plan view of the first embodiment. A rearward end of each of sides 206 is joined to rear portion 207 to form a substantially U-shaped structure that matches the outline of heel 203 (shown in FIG. 2A). Thickness of side walls 206 and rear portion 207 are a matter of design choice and depend upon the rigidity of the material used.

In a preferred embodiment, a neoprene rubber is used for flexible spur 200 and side walls 206 are about seven-thirty seconds inch thick. Preferably, rear portion 207 is somewhat thicker than sides 206 as the rear portion 207 is desirably more rigid than side walls 206. Shank 211 is attached to rear portion 207 and rowel 208 is attached to shank 211 so as to allow rowel 208 to rotate or spin. Front loop 209 extends between the front ends of side walls 206 and is about one-half inch wide and one eighth inch thick.

Important features of the present invention are side grooves 301 and rear groove 302 which are sized and positioned to engage ridges 212 and 213 (shown in FIG. 2B) of riding shoe 201. As shown in FIG. 3, grooves 301 and rear groove 302 are preferably formed as a continuous U-shaped groove along side walls 206 and rear portion 207. In the first embodiment, groove 302 is preferably about one-eighth inch deep at a center point, and gradually tapers as it extends towards side grooves 301. Side grooves 301 also gradually taper having a deepest portion near rear groove 302 and terminating about midway along the length of side walls 206.

FIG. 4 shows a front perspective view of the first embodiment spur. As shown is FIG. 4, groove 302 has a maximum height at the center of rear portion 207. And the preferred embodiment's maximum height is about one-quarter inch. In the preferred embodiment groove 302 extends along the entire inner surface of rear portion 207 and does not taper as it approaches side grooves 301. Side grooves 301 and rear groove 302 are conveniently formed at the same time sides 206 and rear portion 207 are molded. Alternatively, side groove 301 and rear groove 302 can be machined or cut into the inner surfaces of side walls 206 and rear portion 207. Many well known rubber and plastic machining techniques may be used.

Side grooves 301 join continuously with rear groove 302 in the first embodiment. Side grooves 301 preferably taper in height as they approach a termination midway along the length of side walls 206. Again, the particular shape and size of grooves 301 and 302 is easily adapted to the particular needs of a riding shoe 201. Grooves 301 and 302 are generally centered vertically between the top and bottom edges of sides 206 and rear portion 207. In the preferred embodiment sides 206 are about three-quarters inch tall and so grooves 301 are centered or have a center line at about three-eighths inch from either the top or bottom surfaces.

Rear portion 207 is about three-quarters inch thick and so rear groove 302 has a center portion about three eighths inch from the upper or lower surfaces of rear portion 207. Also shown in FIG. 4 is front loop 209 which extends downward from the front edges of side walls 206. Front loop 209 has a horizontal surface for engaging sole 205 (shown in FIG. 2B). The horizontal surface of front loop 209 is substantially perpendicular to the inner surface of side walls 206 and rear portion 207.

FIG. 5–FIG. 7 show various views of the first embodiment of the present invention to provide greater detail and better enable one to make and use the teachings of the present invention. In the side view (shown in FIG. 5), side grooves 301 and rear groove 302 are illustrated by dashed lines to indicate their position on the inner surface of side walls 206. The front end of side walls 206 joint front loop 209 preferably in an arc-shaped junction at the front end of sides 206.

The length of side walls 206 is chosen to match the length of heel 203 (shown in FIG. 2A). Junction 215 is a substantially ninety degree angle so that front loop 209 is downwardly offset from side walls 206. Side walls 206 extend substantially horizontally between rear portion 207 and front loop 209. This horizontal orientation is adapted to match to the overall shape and orientation of the junction between counterheel 202 and heel 203 of riding shoes 201. Shank 211 extends upwardly and rearwardly away from rear portion 207 to hold rowel 208 in position.

FIG. 6 further illustrates that rear portion 207 and rear groove 302 formed therein are oriented substantially horizontally. Rear portion 207 preferably has parallel horizonal upper and lower edges or surfaces as shown in FIG. 6. The horizontal surface of front loop 209 is offset downwardly from rear portion 207 so as to engage heel 203 (shown in FIG. 2B) and to allow front loop 209 to pass under sole 205 (shown in FIG. 2B). In FIG. 7, a portion of side wall 206 is cut away to show groove 301 inside wall 206. Groove 301 and rear groove 302 are substantially centered within the thickness of side wall 206 and rear portion 207 respectively.

The dimensions of grooves 301 and 302 may be readily adapted to a particular protrusion shape formed on riding shoe 201 (shown in FIG. 2). Likewise, the shapes are chosen to mate with the outer surface of counterheel 202 and heel 203 as well as to give spur 200 aesthetic appeal. The dimensions and shapes recited in the particular examples are provided only to aide understanding and are not limitations of the present invention.

2. Example 2

FIG. 8 and FIG. 9 illustrate a second embodiment spur in accordance with the present invention. The view shown in FIG. 8 corresponds to the view of the first embodiment shown in FIG. 3. Likewise, the view shown in FIG. 9 corresponds to the view of the first embodiment shown in FIG. 4. In this second embodiment side walls 806, rear portion 807 and front loop 809 correspond generally to side walls 206, rear portion 207, and front loop 209 shown in FIG. 3.

An important feature of the second embodiment is that side engagements 803 and rear engagement 804 are not continuous along the inner surface of side walls 806 and rear portion 807, respectively. The second embodiment spur 801 is designed to affix to a riding boot (not shown) that has protrusions located to fit into engagements 803 and 804. Any number of engagements 803 and 804 can be provided in a like manner. As shown in FIG. 8, engagements 803 in side walls 806 may pass completely through side walls 806. Engagement 804 formed in rear portion 807 will extend only part way through the thickness of rear portion 807 due to the increased thickness in rear portion 807 and the presence of shank 811 immediately behind rear portion 807.

Alternatively, engagements 803 may be provided only partially through the thickness of side walls 806 as illustrated in the first embodiment. The other features of second embodiment spur 801 have similar construction and operation as described in reference to the first embodiment.

FIG. 9 illustrates a perspective view of second embodiment spur 801 showing that discontinuous engagements 803 and 804 are preferably centered within the height of side walls 806 and rear portion 807. Engagements 803 may be square, rectangular, round, or any other convenient shape to match with protrusions on the riding shoe. It is to be understood that the single groove of the first embodiment may be adapted to fit over a plurality of discrete protrusions on the riding shoe.

Either the first or second embodiments may be made using a flexible, moldable material by molding a spur having a rear body, at least two sides extending forwardly from the rear body. Optionally, a front loop can be molded extending between the two sides. The mold is designed to provide a U-shaped inner surface for frictionally engaging the riding shoe. A rigid spur can be manufactured by shaping a rigid material such as steel by casting or bending the rigid material to dimensions and shapes set out above. During or after the step of molding or shaping, a groove is formed in at least a portion of the U-shaped inner surface. If desired, a shank is affixed to the rear body. The spur is desirably integrally molded as a single unit. When a rigid material is used, conventional welding may be used to attach the several elements to each other as well as screw, rivets and the like.

While the particular embodiments have been described using a molded flexible material, other flexible materials and manufacturing processes are known which can be adapted to produce a spur in accordance with the present invention. Also, the spur may be larger or smaller than the specific embodiments to adequately affix to a particular shoe. It is contemplated that discontinuous engagements 803 and 804 may be used alone or in combination with the continuous engagement including side grooves 301 and rear groove 302 of the first embodiment, so that the second embodiment spur 801 may be adapted to fit more than one type of shoe. It is to be expressly understood that the claimed invention is not to be limited to the description of the preferred embodiment but encompasses other modifications and alterations within the scope and spirit of the inventive concept.

We claim:

1. A spur for mounting on a riding shoe having a heel and protruding means, the spur comprising:

at least two opposing sides;

a rear body connected to one end of each of said sides, said rear body extending generally upward from said sides; and means on said rear body and sides for selectively engaging said protruding means to firmly hold said spur against said protruding means to prevent upward and downward movement of said spur on said riding shoe.

2. The spur of claim 1 further comprising a front loop stretching between and disposed downwardly from the other end of said sides, said at least two sides, said rear body and said front loop being formed of flexible material, said front loop is adapted to stretch over said heel to engage a front surface of said heel with said rear body disposed at the rear of said riding shoe.

3. The spur of claim 2, wherein said front loop is provided with a downward offset connected to each of said other end of said sides.

4. The spur of claim 1 wherein said at least two sides and said rear body comprise a rigid material.

5. A spur for mounting removably on a canvas riding shoe having a heel and an integral ridge, the spur comprising:

a rear body;

a shank attached to said rear body;

at least two sides extending frontwardly from said rear body;

a front loop spanning between and disposed downwardly from said two sides; and said rear body and sides having a groove therein, said groove being adapted to engage said ridge when said spur is mounted on said shoe, preventing said spur from moving upwardly or downwardly.

6. The spur of claim 5, wherein said front loop is provided with a downward offset connected to each of said sides.

7. The spur of claim 5, wherein said shank is integral with said rear body.

8. The spur of claim 5, wherein said shank has an upright, longitudinal slot in its distal portion.

9. The spur of claim 8, further comprising pin means extending across said slot for rotatably supporting a rowel.

10. An improved spur for mounting on a canvas riding shoe, the shoe having a heel and at least one ridge affixed to said shoe, the spur having a rear body, two sides extending frontwardly in spaced, parallel relation from said rear body, a front loop depending from said two sides, said front loop having downward offsets connecting said front loop with each of said two sides, wherein the improvement comprises:

the interior of said rear body and a major portion of each of said two sides having at least one groove therein for selectively engaging said at least one ridge on said shoe when said front loop engages the front of said heel and said sides are stretched between said front loop and said rear body.

11. The spur of claim 10, wherein said rear body is arcuate.

12. The spur of claim 10, wherein said rear body, sides, and front loop are molded integrally.

13. A method of making a spur, said method comprising the steps of:

molding a spur having a rear body, at least two sides extending forwardly from said rear body, and a front loop extending between said two sides, said rear body and said sides arranged so as to provide a U-shaped inner surface for frictionally engaging a shoe;

forming a groove in at least a portion of said U-shaped inner surface; and affixing a shank to said rear body.

14. The method of claim 13, wherein said spur is integrally molded.

* * * * *